US005464317A

United States Patent [19]

Foster et al.

[11] Patent Number: 5,464,317

[45] Date of Patent: Nov. 7, 1995

[54] REGISTRATION POWER STACKER

[75] Inventors: Dean H. Foster, Stratford; Russell W. Holbrook, Middlebury; James Morabito, Bethel; Morton Silverberg, Westport; Steven A. Supron, New Haven, all of Conn.

[73] Assignee: Pitney Bowes Inc., Stamford, Conn.

[21] Appl. No.: 245,302

[22] Filed: May 5, 1994

Related U.S. Application Data

[63] Continuation of Ser. No. 978,010, Nov. 18, 1992, abandoned.

[51] Int. Cl.[6] ..... B65G 57/00

[52] U.S. Cl. ..... 414/798.2; 414/792.7; 198/534; 271/2

[58] Field of Search ..... 414/788.1, 792.7, 414/798.2, 798.8; 271/220, 221, 2; 198/525, 534

[56] References Cited

U.S. PATENT DOCUMENTS

| | | | |
|---|---|---|---|
| 2,302,261 | 11/1942 | Ryan | 271/2 |
| 2,554,577 | 5/1951 | Lauffer | 271/2 |
| 2,554,578 | 5/1951 | Lauffer | 271/2 |
| 3,630,517 | 12/1971 | Enskat | 271/220 |
| 3,700,232 | 10/1972 | Wiegert et al. | 414/798.8 |
| 3,860,127 | 1/1975 | Fassman | 214/6 N |
| 3,945,635 | 3/1976 | Marin | 271/202 |
| 4,371,157 | 2/1983 | Hunt et al. | 271/2 |
| 4,911,422 | 3/1990 | Auerbach | 271/2 |
| 5,022,638 | 6/1991 | Ifkovits, Jr. | 271/2 |
| 5,026,340 | 6/1991 | Thompson | 271/2 |

*Primary Examiner*—Michael S. Huppert
*Assistant Examiner*—Gregory A. Morse
*Attorney, Agent, or Firm*—Angelo N. Chaclas; Charles G. Parks, Jr.; Melvin J. Scolnick

[57] ABSTRACT

A power stacker provides for receiving lengthwise orientated envelopes projected longitudinally onto the power stacker at a receiving end of the power stacker from an envelope feed device. The power stacker has a base supporting both an elongated deck and registration wall, an envelope transport system for transporting envelopes along the deck from the receiving end to a stack end of the deck. The transport system includes a plurality of friction belts extending partly along the deck and a power stack wheel pivotally mounted to the registration wall. An upper deflection flap at having one end pivotally mounted to the registration wall at the receiving end of the deck at a vertical elevation above that of the longitudinal feed level of the feed device, the upper deflection flap to contact the deck at it other end at a predetermined nominal angle forward of the power stack wheel. A deflector ramp is fixably mounted to a lateral positioning member, the deflector ramp being horizontally elongated and set at a fixed inclining horizontal angle nominally set at 20 degree. The lateral positioning member is adjustably mounted to the deck and the deflector fixably mounted thereto for selectively positioning the deflector ramp laterally with respect to the registration wall. A deflector bench is fixably mounted to the registration wall at the receiving end of the deck at a vertical elevation just below the longitudinal feed level of the feed device for preventing opening of the envelope.

10 Claims, 5 Drawing Sheets

REGISTRATION POWER STACKER

CROSS REFERENCE TO RELATED APPLICATION

This application is a continuation of U.S. patent application Ser. No. 07/978,010, filed Nov. 18, 1992 and entitled "IMPROVED REGISTRATION POWER STACKER, " now abandoned.

BACKGROUND OF THE INVENTION

The present invention relates to power stackers employed to collect and stack envelopes or the like.

U.S. Pat. No. 5,137,415 describes a power stacker having a base section both a deck and a laterally positioned registration wall. One end of the power stacker is aligned to the ejection end of a postage meter mailing machine. The other end of the power stacker has a displaceable end wall. The displaceable end wall of the power stacker is vertically reclined and utilizes support rods slidably mounted in the base, one end of the displaceable wall being mounted to the displaceable end wall. Endless belts are mounted within the base such that a portion is exposed along slots in the deck. The belts are driven by a drive train such that received envelopes are transported along the deck in a shingled manner to a plurality of threaded hubs. It is the function of the threaded hubs to engage the trailing end of the respective envelopes and cause the respective envelopes to assume a reclined vertical orientation biased by the displaceable end wall. The collection of envelopes causes the displaceable end wall to displace laterally under the influence of the collected envelopes. The power stacker further includes pivotally mounted on the registration wall a power stack wheel assembly for providing a biasing force to the stream of shingled envelopes being transported by the belts. A detailed description of a suitable power stack wheel assembly is presented in U.S. Pat. No. 5,186,452.

It is the intended purpose of the power stacker to consistently stack envelopes of varying weight, thickness and paper roughness. Envelopes are to be received by the power stacker in a seriatim manner. The envelopes are first collected on the deck of the power stacker in a shingled manner and then transported to the stack wall for vertically directed collection. Empirical testing of the described power stacker, in combination with a particularly suited postage meter mailing machine, has demonstrated certain combination of envelopes of varying weight, thickness and paper roughness under certain operating perimeter are not properly received by the power stacker to produce a suitable shingling of the mail stream. As a result, under those conditions the mail stream is improperly transported along the deck in a misaligned manner for proper stacking against the displaceable stack wall. It has been postulated that the projection angle of the envelope should be maintained within a specified range which is a function of envelope size, thickness and weight.

SUMMARY OF THE PRESENT INVENTION

It is an objective of the present invention to present an improved power stacker which provides improved registration of delivered envelopes and is particularly suited for stacking envelopes received from an associated mailing machine wherefrom envelopes are seriatimly delivered to the power stacker.

It is a further objective of the present invention to present an improved power stacker having improved registration wherein envelopes are projected to the power stacker from a delivering apparatus in a seriatim manner and whose projection is influenced by deflectors to assure proper shingling of the subject envelope relative to the preceding envelope.

A power stacker includes a base section supporting a deck and a laterally positioned registration wall. One end of the power stacker is aligned to the ejection end of a postage meter mailing machine. The deck of the power stacker is vertically positioned below the horizontal projection of the postage meter mailing machine deck.

The other end of the power stacker has a displaceable end wall. The displaceable end wall of the power stacker is vertically reclined and utilizes support rods slidably mounted in the base, one end of the displaceable wall being mounted to the displaceable end wall. Endless belts are mounted within the base such that a portion is exposed along slots in the deck. The belts are driven by a drive train such that received envelopes are transported along the deck in a shingled manner to a plurality of threaded hubs. It is the function of the threaded hubs to engage the trailing end of the respective envelopes and cause the respective envelopes to assume a reclined vertical orientation biased by the displaceable end wall. The collection of envelopes causes the displaceable end wall to displace laterally under the influence of the collected envelopes. The power stacker further includes, pivotally mounted on the registration wall, a power stack wheel assembly for providing a biasing force to the stream of shingled envelopes being transported by the belts. A detailed description of a suitable power stack wheel assembly is presented in U.S. Pat. No. 5,186,452. It is noted that in the preferred embodiment of the power stacker, the endless belts are discontinuously driven, that is, the endless belts are advanced a measured amount for each envelope delivered to the power stacker. In the most preferred embodiment of the power stacker, the drive system of the power stacker is under the influence of a microcontroller of an associated mailing machine which delivers the envelopes to the power stacker.

To insure proper alignment of the delivered envelopes, the power stacker includes an upper deflector flap and a lower deflector assembly. The upper deflector and lower deflector assembly are horizontally aligned and vertically spaced to receive an envelope vertically between the upper deflector flap and the lower deflector assembly. The deflectors are configured to cause the trajectory of received envelopes to conform to a defined path.

DETAILED DESCRIPTION OF THE PREFERRED EMBODIMENT

Figure 1:
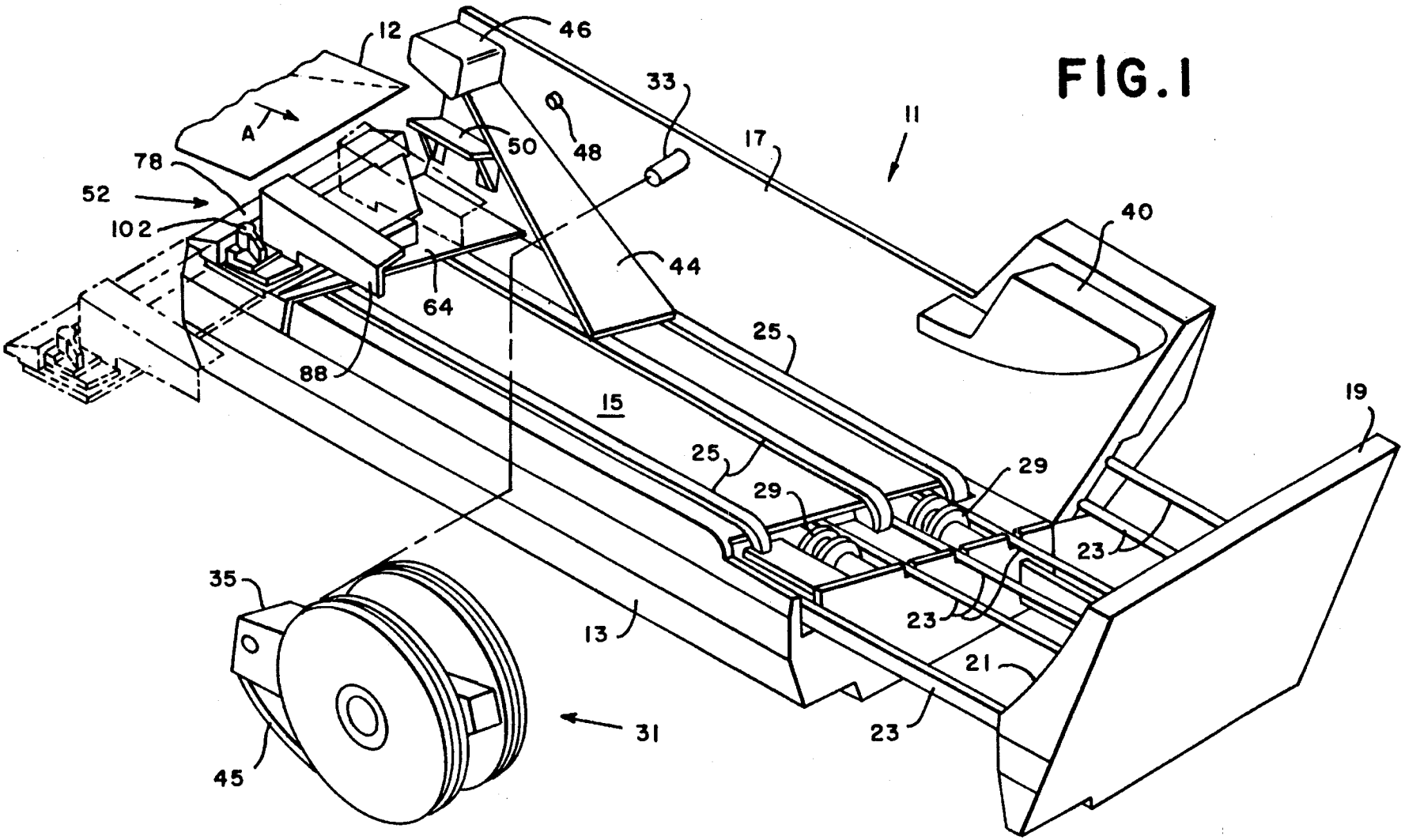
FIG. 1 is a perspective view of a power stacker having an upper deflector and lower deflector assembly in accordance with the present invention.
Figure 2:
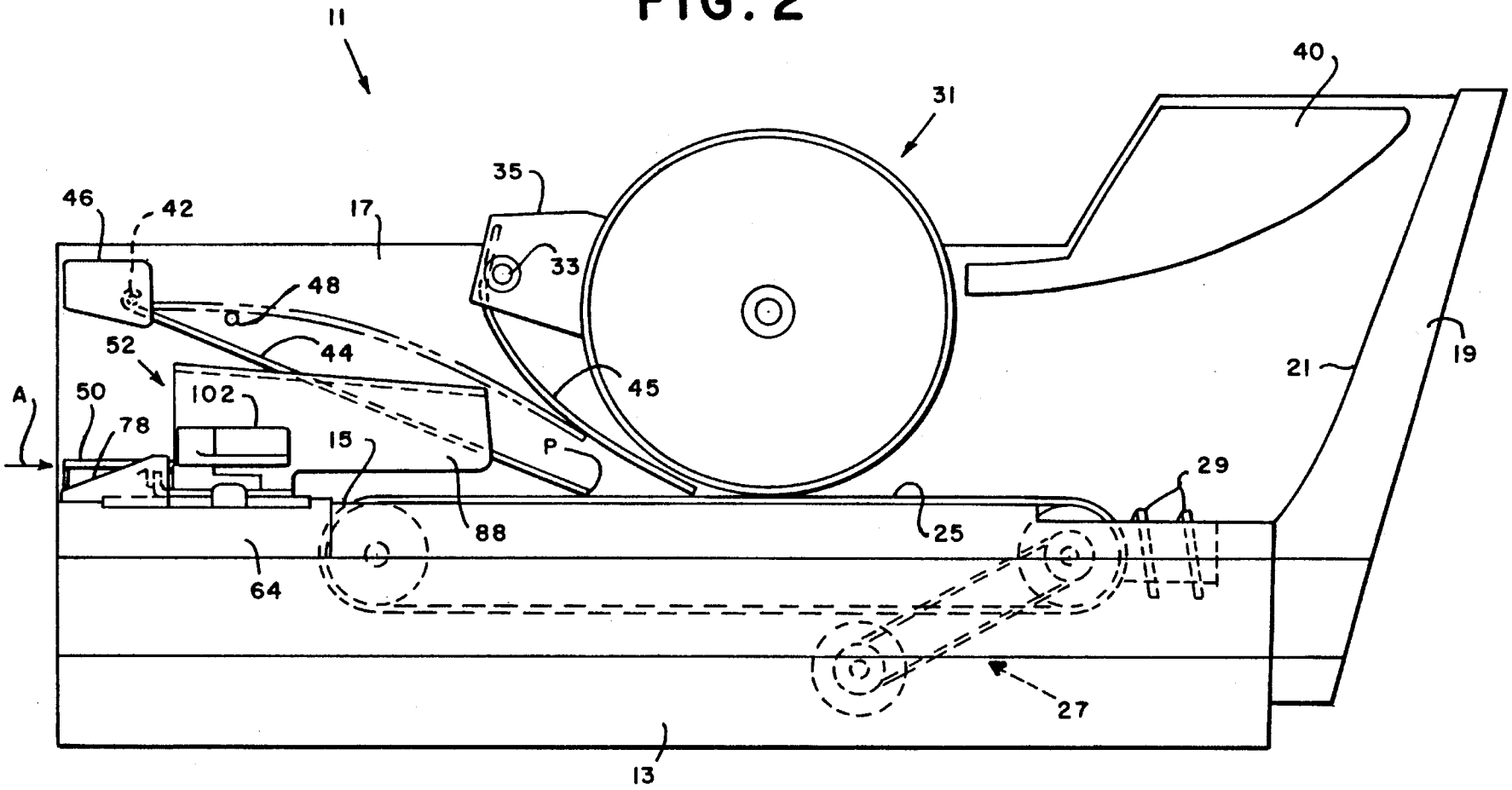
FIG. 2 is a side sectional view of the power stacker having an upper deflector and lower deflector assembly in accordance with the present invention.
Figure 3:
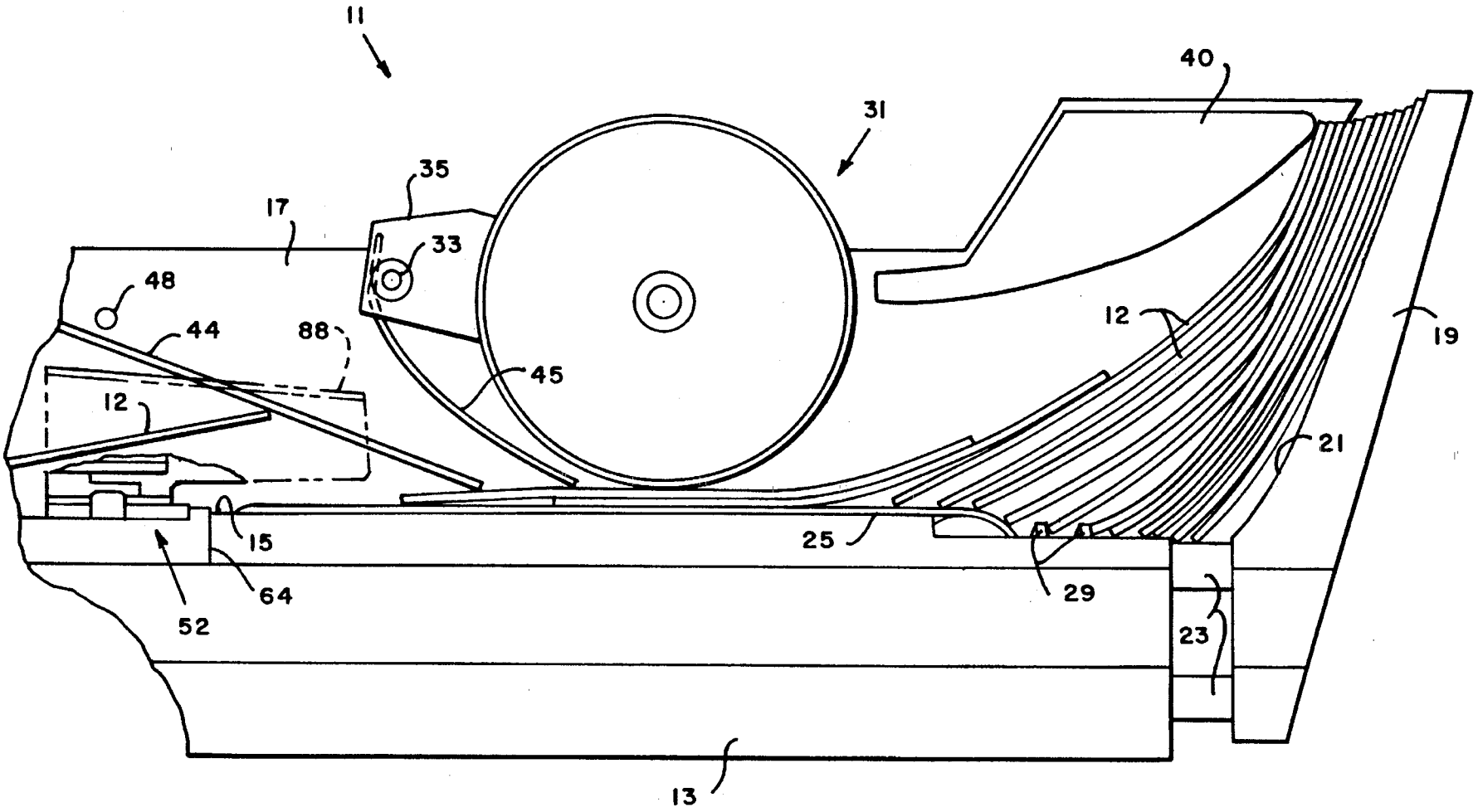
FIG. 3 is a side sectional view of the power stacker having an upper deflector and lower deflector assembly having envelopes stacked along the stack wall in accordance with the present invention.

Referring to FIGS. 1, 2 and 3, a power stacker, generally indicated as 11, includes a base section 13 supporting both a deck 15 and a registration wall 17. A displaceable end wall 19 having a vertically reclined stack wall 21 has one end of a plurality of support rods 23 fixably mounted to the end wall 19. The support rods 23 are slidably mounted in the base section 13. A plurality of endless belts 25 are rotatively mounted in the base 13 such that a portion of the respective belts 25 ride in slots in the deck 15 under the influence of a drive train 27. A plurality of threaded hubs 29 are rotatively mounted in the base 13 such that a portion of the respective hubs 29 are exposed through a transverse slot in the deck 15. A power stack wheel assembly 31 is pivotally mounted to a pivot pin 33 extending from the registration wall 17 for the purpose of applying a downward force to improve envelope transport on the endless belts 25. The assemblies thus far have been generally described in a detailed description of the preferred assemblies as presented in U.S. Pat. No. 5,137,415 issued Aug. 11, 1992, entitled POWER STACKER and U.S. Pat. No. 5,186,452, issued Feb. 16, 1993, entitled IMPROVED POWER STACKER APPARATUS, commonly assigned and here incorporated by reference.

In order to improve power stacker performance a vertical guide member 40 is mounted to the registration wall 17. A pin 42 is fixably mounted to the registration wall 17 by any conventional means. A deflector flap 44 is pivotally mounted to the pin 42 at one end, the other end of the deflector flap 44 resting on the deck 15. A deflector cap 46 is fixably mounted to the registration wall 17, by any conventional means, around the pin 42 and pivot end of deflector flap 44. A deflector post 48 is fixably mounted to the registration wall 17, using conventional means, above the deflector flap 44. The deflector flap 44 can be pivoted in a raised position above the post 48 and to thereafter rest on post 48 when processing windowed envelopes. A lower deflection bench assembly 50 is mounted to the registration wall 17 below the deflector flap 44 and generally aligned below the deflector cap 46.

Figure 4:
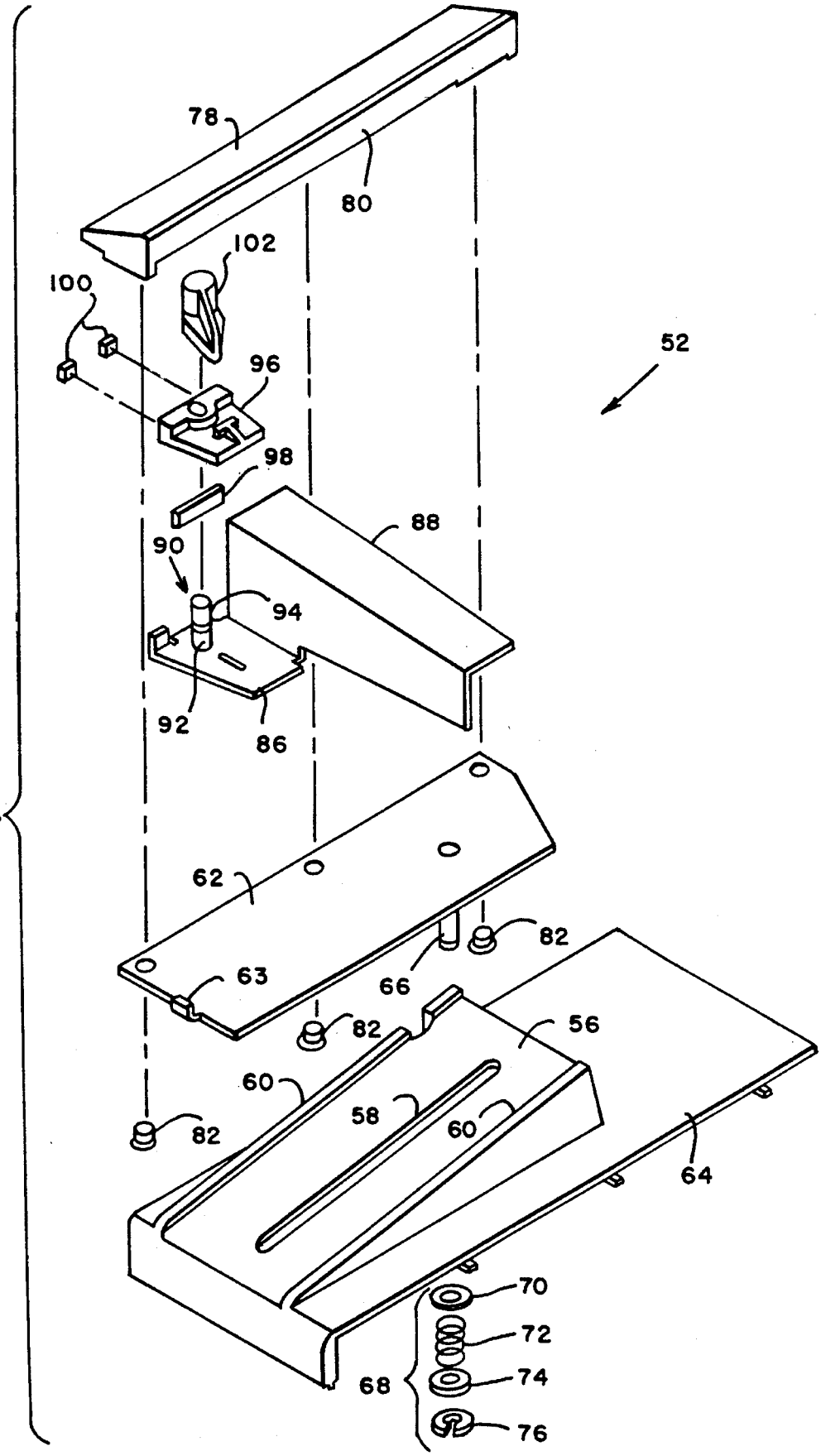
FIG. 4 is an exploded view of the lower deflector assembly in accordance with the present invention.

Referring to FIG. 4, aligned generally below the deflector cap 46 is a lower deflector assembly, generally indicated as 52. The lower deflector assembly 52 includes a base plate 64 which preferably is detachably mounted in a transverse aperture (not shown) in the deck 15 by any suitable means. Ramp 56 is formed on the base plate 54. The ramp 56 includes a slot 58 and confining rails 60 and a slide plate 62. The slide plate 62 includes an adjusting tab 63 and a formed down extending stud 66 which extends to the slot 58. The slide plate 62 is mounted using an attachment assembly 68. The attachment assembly 68 includes a washer 70 placed around the stud 66 followed by a compression spring 72, second washer 74 and ring clamp 76. A backing strip or deflector ramp 78 having a locking face 80 is fixably mounted to the slide plate 62 by any conventional means such as by screws 82. The deflector ramp 78 acts as a launch to heavier envelopes to assure that the leading edge of the envelope overlaps the trailing edge of the prior envelope.

The base 86 is slidably supported on the slide plate 62. The base 86 supports a side guide 88. A bisectional post 90 is rotatively mounted to the base 86 by any conventional means. The first post 92 section is asymmetrical and is located below the second post 94 section. A flexible cap 96 is placed around the bisectional post 90 such that a portion of the cap 96 is positioned around the lower post portion 92.

Spring strip 98 is fixably mounted in an outer face of the cap 96 aligned opposite the asymmetric first post section 92. Friction pads 100 are fixably mounted to the spring strip 98 and located opposite the locking face 80 of the slide plate 62 such that the friction pads 100 may be placed in forced contact with the locking face 80. A handle 102 is fixably mounted to the second post section 94 above the cap 96. The handle is eccentrically formed such that in a first position the friction pads 100 are in forced engagement with the locking face 80 and when rotated to a second position, the friction pads 100 are released.

In operation, in the preferred embodiment, an envelope is delivered from the mailing machine feed device to the power stacker 11 at a given velocity in the direction of arrow "A". The envelope 12 is caused to encounter the upper deflector flap 44 to be guided to the deck 15 at the point "P" which is approximately the fall position of the upper deflector flap 44 onto the deck. The envelope 12 is restricted from encountering the deck at a point forward of point "P" by bench 50 and the lower deflector assembly 52. Bench 50 also prevents the envelope flap from springing open while in flight. It is noted that the lateral position of the lower deflector assembly 52 may be adjusted to accommodate situations where oversized or undersized envelopes are intended to be stacked.

The described deflection system restricts the angle of attack which an envelope can approach the transport belts. This is important because in an automated mail processing system the speed and the projection of the ejection angle of the mail delivering device, preferably a mailing machine, cannot be held relatively constant irrespective of variations in the size and thickness of the envelope within a empirically determined range. And, also, of additional benefit, proper stacking of the envelope will not be adversely effected by the variation of the weight of the envelope's contents or shifting of the contents which factors effect the attack angle of an envelope onto the stacker deck. Further, compensation is provided for variation of the ejection speed due to slippage between the ejection system of the ejection device, e.g., mailing machine, the power stacker which is substantially independent of variation in the envelope size, thickness, weight and material composition of the envelope. This capability offers substantial benefit by reducing the degree of complexity which would otherwise be necessary in providing system control of the ejection system of the mailing machine.

Figure 5:
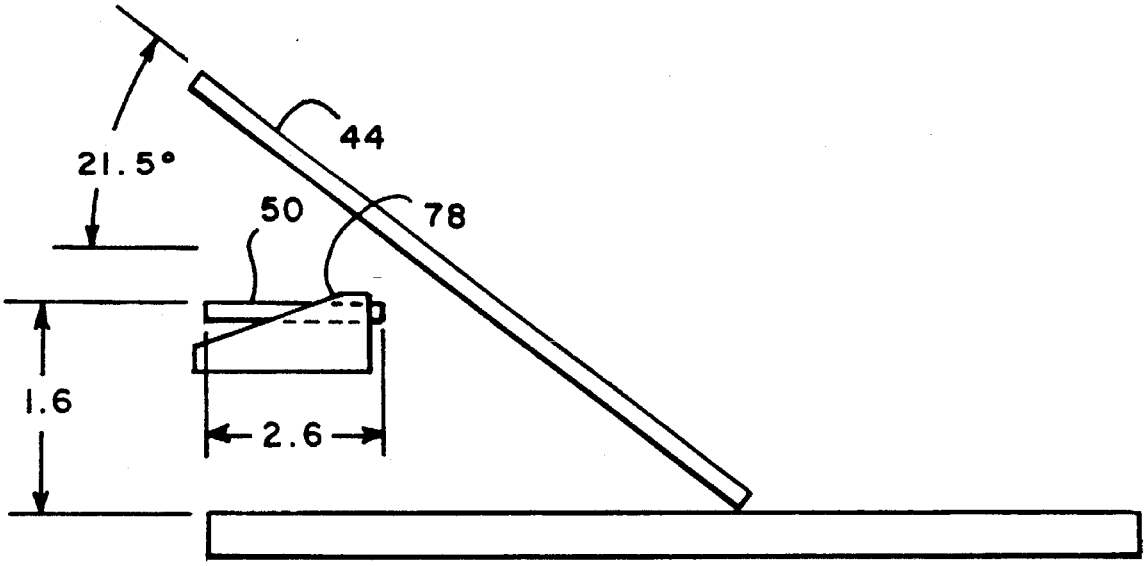
FIG. 5 is a schematic view of the relative position of the upper and lower deflectors in accordance with the present invention.

Referring to FIG. 2 and FIG. 5, in the most preferred embodiment of the present invention the deflector ramp 78 is set at an inclined angle of 20 degrees and extends from below the longitudinal feed level of the feed device to above the longitudinal feed level. The deflector bench 50 is set adjacent to and 0.125 inches and extends a length 2.6 inches. The upper defector 44 is set at a nominal angle of 21.5 degrees. As a result, the ramp deflector raises the trajectory of the received envelope to ensure it contacts the upper deflector and properly overlaps the trailing edge of the prior envelope.

It is noted that optionally a second deflector 45 having one end pivotally mounted around pivot pin 33 inside the wheel assembly housing 35 and extending through an aperture in the housing 35 to the deck 15 may be provided. The second deflector 45 provides additional drive friction on the lower belts.

The afore description represents the most preferred embodiment of the present invention and should not be viewed as limiting. The scope of the present invention is defined by the appendixes claims.

What is claimed is:

1. An improved power stacker for receiving lengthwise orientated envelopes projected longitudinally onto said power stacker at a receiving end of said power stacker from a feed device, said feed device for feeding said envelopes each having a leading edge in a direction of travel along a feed plane, said power stacker having a base supporting both an elongated deck and a laterally positioned vertical registration wall, an envelope transport means for transporting envelopes along said deck from said receiving end to a stack end of said deck, wherein said improvement comprises:

a first deflector means for deflecting the leading edge of said envelope upward above the feed plane of said feed device and away from said deck, and a second deflector means downstream in the direction of travel from said first deflector means for deflecting the leading edge of said envelope downward onto said deck and in communication with said transport means.

2. An improved power stacker as claimed in claim 1 wherein said second deflector means comprises an upper deflector flap having one end pivotally mounted to said registration wall at said receiving end of said power stacker at a vertical elevation above that of said feed plane of said feed device, said upper deflector flap having another end that contacts said deck at a predetermined nominal angle, and means for restricting the pivot angle of said upper deflector flap.

3. An improved power stacker as claimed in claim 1 wherein said first deflector means comprises a deflector ramp fixably mounted to said deck at said receiving end of said power stacker below said second deflector means and transversely displaced from said registration wall, said deflector ramp being horizontally elongated and set at a fixed inclining horizontal angle between 10 and 30 degrees from said feed plane.

4. An improved power stacker as claimed in claim 2 wherein said first deflector means comprises a deflector ramp fixably mounted to said deck at said receiving end of said power stacker below said upper deflector flap and transversely displaced from said registration wall, said deflector ramp being horizontally elongated and set at a fixed inclining horizontal angle between 10 and 30 degrees from said feed plane.

5. An improved power stacker for receiving lengthwise orientated envelopes projected longitudinally onto said power stacker at a receiving end of said power stacker from a feed device, said feed device for feeding said envelopes each having a leading edge in a direction of travel along a feed plane, said power stacker having a base supporting both an elongated deck and a laterally positioned vertical registration wall, an envelope transport means for transporting envelopes along said deck from said receiving end to a stack end of said deck, said transport means including a plurality of friction belts extending partly along said deck and a power stack wheel pivotally mounted to the registration wall, wherein said improvement comprises:

a first deflector means having a deflector ramp for deflecting the leading edge of said envelope upward above said feed plane of said feed device and away from said deck, and a second deflector means downstream in the direction of envelope travel from said first deflector means for deflecting the leading edge of said envelope downward onto said deck and in communication with said transport means;

said deflector ramp fixably mounted to said deck at said receiving end of said power stacker below said second deflector means and transversely displaced from said registration wall, said deflector ramp being horizontally elongated and set at a fixed inclining horizontal angle between 10 and 30 degrees from said feed plane.

6. An improved power stacker as claimed in claim 5 wherein said second deflector means comprises an upper deflector flap having one end pivotally mounted to said registration wall at said receiving end of said power stacker at a vertical elevation above that of said feed plane of said feed device, said upper deflector flap having another end that contacts said deck at a predetermined nominal angle and forward of said power stack wheel, and means for restricting the pivot angle of said upper deflector flap.

7. An improved power stacker as claimed in claim 6 wherein said first deflector means comprises a side guide mounted to said deck at said receiving end of said power stacker below said upper deflector flap and laterally displaced from said registration wall, said side guide having both a laterally positioned vertical surface for aligning said envelope to said registration wall and a horizontal surface vertically spaced above said deck for restricting said upward deflection of said leading edge of said envelope.

8. An improved power stacker as claimed in claim 7 wherein said first deflector means further comprises a lateral positioning means adjustably mounted to said deck having said side guide fixably mounted thereto, said lateral positioning means for selectively positioning said side guide laterally with respect to said registration wall.

9. An improved power stacker as claimed in claim 6 further comprising a deflector bench fixably mounted to said registration wall at said receiving end of said power stacker at a vertical elevation just below said feed plane of said feed device for preventing opening of said envelope.

10. An improved power stacker for receiving lengthwise orientated envelopes projected longitudinally onto said power stacker at a receiving end of said power stacker from a feed device, said feed device for feeding said envelopes each having a leading edge in a direction of travel along a feed plane, said power stacker having a base supporting both an elongated deck and a laterally positioned vertical registration wall, an envelope transport means for transporting envelopes along said deck from said receiving end to a stack end of said deck, said transport means including a plurality of friction belts extending partly along said deck and a power stack wheel pivotally mounted to the registration wall, wherein said improvement comprises:

a deflector ramp for deflecting the leading edge of said envelope upward above said feed plane of said feed device and away from said deck, said deflector ramp being fixably mounted to said deck at said receiving end of said deck, said deflector ramp being horizontally elongated and set at a fixed inclining horizontal angle between 10 and 30 degrees from said feed plane;

a deflector bench fixably mounted to said registration wall at said receiving end of said power stacker at a vertical elevation just below said feed plane of said feed device for preventing opening of said envelope;

a side guide mounted to said deck at said receiving end of said power stacker below said upper deflection flap and laterally displaced from said registration wall, said side guide having both a laterally positioned vertical surface for aligning said envelope to said registration wall and a horizontal surface vertically spaced above said deck for restricting said upward deflection of said envelope;

a lateral positioning means adjustably mounted to said deck having said side guide fixably mounted thereto, said lateral positioning means for selectively positioning said side guide laterally with respect to said registration wall; and an upper deflector flap having one end pivotally mounted to the registration wall at said receiving end of said power stacker at a vertical elevation above that of said feed plane of said feed device, said upper deflector flap to contact said deck downstream in the direction of travel from said deflector ramp at its other end, said deflector flap contacting said deck to form a predetermined nominal angle and forward of said power stack wheel, and means for restricting the pivot angle of said upper deflector flap.

* * * * *